United States Patent [19]

Jones

[11] 4,145,046

[45] Mar. 20, 1979

[54] SOCCER TRAINING APPARATUS

[76] Inventor: Ronald Jones, 1204 Heywood St., N. Vancouver, B.C., Canada, V7L 1H4

[21] Appl. No.: 852,826

[22] Filed: Nov. 18, 1977

[51] Int. Cl.[2] ..... A63B 43/02

[52] U.S. Cl. ..... 273/55 B; 273/58 C

[58] Field of Search ..... 273/58 C, 55 R, 55 B, 273/95 A, 95 AA, 200 R

[56] References Cited

U.S. PATENT DOCUMENTS

| | | | |
|---|---|---|---|
| 3,168,312 | 2/1965 | Davis | 273/58 C X |
| 3,382,609 | 5/1968 | Neanhouse | 273/58 C X |
| 4,071,241 | 1/1978 | Garcia | 273/58 C X |

FOREIGN PATENT DOCUMENTS

| | | | |
|---|---|---|---|
| 329184 | 5/1930 | United Kingdom | 273/58 C |

*Primary Examiner*—George J. Marlo

*Attorney, Agent, or Firm*—Robert D. Farkas

[57] ABSTRACT

A soccer training apparatus utilizes a hollow handle portion having a shaft upon which one end of a flexible line may be wound. The shaft, contained within the handle, is biased by a helical spring so as to rotate in a preferred direction. A ratchet and a manually releasable pawl permits the line to be unwound from the shaft when a force exerted on the line overcomes the bias force of the spring. The other end of the line is secured to a solid rubber-like ball by passing through an elongated opening in the ball and engaging one end of a coil spring residing in the passageway. The other end of the coil spring is prevented from emerging from the passageway by a shoulder therein. A knot in the line prevents the line from leaving the confines of the passageway. In use, a casting force exerted on the handle, permits the ball to extend in the direction of the cast. Releasing the pawl permits the line to rewind on the shaft under the control of the helical spring, thus returning the ball to the user after casting.

7 Claims, 3 Drawing Figures

SOCCER TRAINING APPARATUS

BACKGROUND OF THE INVENTION

1. THE FIELD OF THE INVENTION

This invention relates to tethered balls and more particularly to that class of apparatus in which the tethered line may be extended selectively at the will of the user.

2. DESCRIPTION OF THE PRIOR ART

The prior art abounds with games and exercises utilizing tethered balls. U.S. Pat. No. 2,765,170 issued on Oct. 2, 1956 to D. L. Brown discloses a handle portion secured to an elongated coiled spring. The free end of the coil spring is attached to a ball simulated to resemble a baseball. Such apparatus is particularly useful in practicing batting.

U.S. Pat. No. 3,879,038 issued Apr. 22, 1975 to D. R. Tremblay teaches a ball game made of a spongy ball connected to the end of a stick by an elastic cord. The stick is slightly flexible and the cord is a rubber-like string covered by an elastic textile sheathing to cut down on the elongation and to increase the response of the ball. The player grips the stick and bounces the ball back and forth on the floor or a wall. The game is designed to develop skill and rhythm.

U.S. Pat. No. 3,907,297 issued on Sept. 23, 1975 to D. W. Fox et al. discloses an athletic improvement device providing activity for a pair of players: one batter and one pitcher. The ball is "pitched" to the batter by the pitcher rotating the device around his head. A perforated ball is secured to one end of a tether line, and the opposite end of the tether line is spring-attached to a pivoting member attached to a wooden insert in a plastic handgrip. This device permits the ball to extend outwardly from the end of the pivoting member by the extension of the connecting spring.

SUMMARY OF THE INVENTION

A primary object of the present invention is to provide a tethered ball whose tether line length may be adjusted at the will of the user.

Another object of the present invention is to provide a tether line which is automatically retractable in length into a handle portion, thereby facilitating the use of the appartus in a variety of games and exercises without requiring line replacements or other complicated adjustment.

Still another object of the present invention is to provide a tether ball wherein the ball may extend along the length of the tether line to which it is attached by virtue of the inertia of the ball as the ball is cast outwardly from a user's hand.

Yet another object of the present invention is to provide an inexpensive, easily fabricated tethered ball apparatus useful in a wide variety of games, exercises and other functional uses.

Heretofore, tethered balls had a fixed length tether line in which the ball was secured a fixed distance, depending upon the length of the line employed, relative to a point at the end of the line attached to a stick, pole or other object. Frequently, a hand of a user was attached directly to the other end of the line. Some devices enabled the line to extend in length or retract in length by utilizing a spring element in the length of the line or to use an extensible cord. However, such devices simply had limited use by virtue of the fact that the installed spring or the extensibility of the line itself limited the maximum extension of the line and thereby limited the use of the apparatus. Finally, the tethered line to which balls were attached did not produce a device which enabled the tethered ball to extend outwardly from the end of the tether line attached thereto. This failure prevented the apparatus to act like a free object in free flight when the tether line was secured to a stationary object. Thus, the ball itself could not act as the equivalent of a ball that has been thrown or batted from a user's hand or bat. More particularly, whilst engaging in the sport of soccer, it is highly desirable to have a soccer ball secured to a tether line act in a manner equivalent to a soccer ball which has been discharged in free flight and is acting in response to the forces exerted on the ball prior to its flight. The present invention recognizes these deficiences and provides a ball whose extensibility from the hands of the user is totally adjustable by extending the length of the line to any desired position. Furthermore, a spring, acting on the end of the line affixed to a handheld handle, enables a force to be exerted on the line which restricts the motion of the ball when the ball is travelling at slow speeds and exerts a different force on the ball when the ball is travelling at high speeds. When the tether line is caused to be locked to the handle, the ball itself is free to extend or retract from the end of the line attached to the ball, utilizing an additional spring therefor, so as to permit the ball to have an independent motion irrespective of the locked condition of the line. Thus, the present invention is suitable not only as a soccer training apparatus, but as an exerciser and as a casting device suitable for casting any selected distance limited only by the total length of the line.

These objects as well as other objects of the present invention will become more readily apparent after reading the following description of the accompanying drawings.

DESCRIPTION OF THE PREFERRED EMBODIMENT

Figure 1:
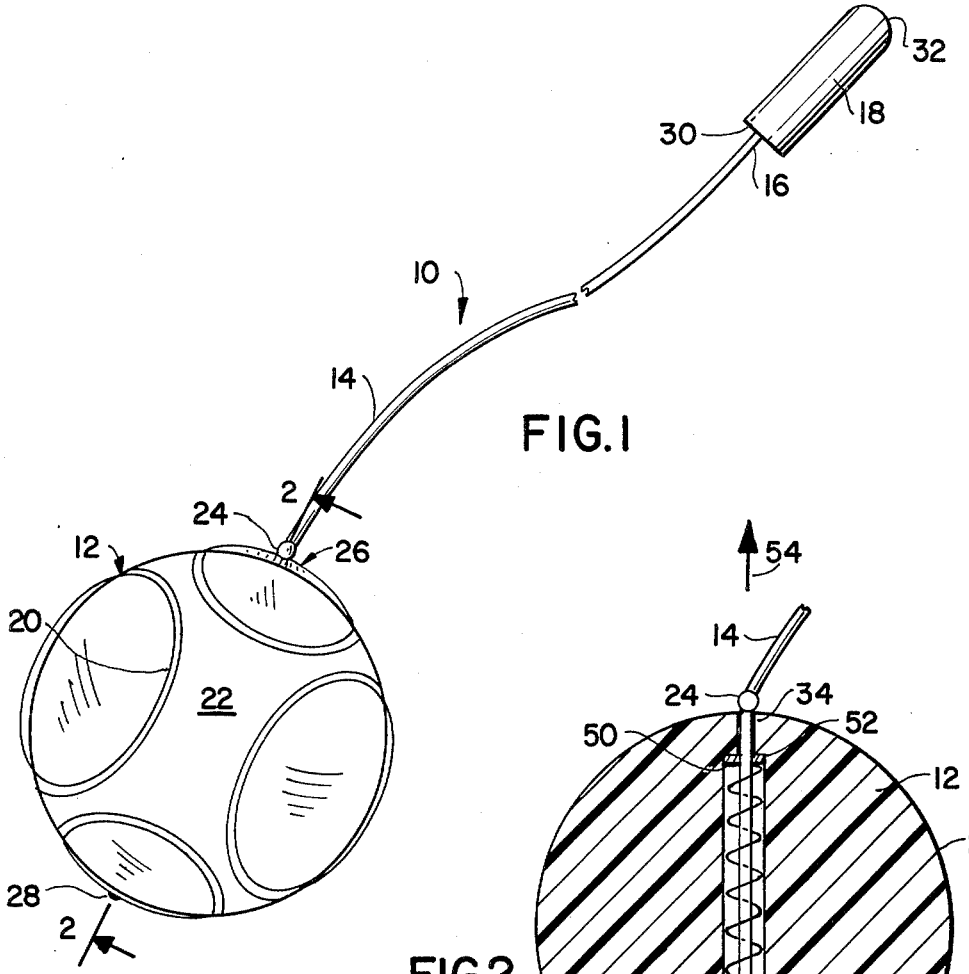
FIG. 1 is a side elevation view of the present invention.

The structure and method of fabrication of the present invention is applicable to an elastic rubber-like ball having an elongated passageway passing through the origin of the spherical ball. The outside surface of the ball may be decorated so as to resemble a soccer ball. The passageway has a major portion of its length of a greater diameter than the remaining portions of the length of the passageway. A coil-type spring, preferably fabricated from a metallic material, such as spring steel, is located in the large diameter length of passageway and coaxially aligned therewith. A washer is installed at the junction of the smaller diameter passageway length and the larger diameter passageway length. An additional washer is installed at the end of the coil spring adjacent the surface of the ball. A flexible line, preferably fabricated from a plastic monofilament such as polyamide is installed within the passageway so as to have a knot located on the outermost lateral surface of the additional washer. A knot is also installed on the portion of the length of the line emerging outwardly from the end of the smaller diameter passageway located at the intersection of the surface of the ball. The additional washer may have an outside diameter such that it engages frictionally with the walls of the larger diameter passageway. If desired, the additional washer may have an outside diameter smaller than the inside diameter of the larger diameter passageway so as to enable the line to move within both passageways freely, limited only by the forces exerted on the line by the coil spring.

The other end of the line passes through an opening centrally located at one end of an elongated hollow handle. The cavity located within the handle houses an axle extending transverse to the longitudinal axis of the handle. Such axle is journaled to the handle and is biased in one direction of rotation by a helical spring, having one end thereof secured to the walls of the cavity and the other end thereof secured to the axle. The axle is also limited in travel in the reverse direction by a plurality of ratchet-like teeth extending radially outwardly from the axle, such teeth being secured to a wheel fixedly secured to the axle and journaled so as to rotate concurrently therewith. An off-set arm is pivotably secured to the housing having one end thereof passing through an opening in the handle and the other end thereof engaging the ratchet-like teeth in pawl fashion. Another spring may be utilized to bias the arm so as to have its ratchet engaging end biased toward the ratchet. The end of the line passing through the opening in the end of the handle is secured to the axle and permitted to be wound thereupon dependent upon the direction of rotation of the axle. In use, the line may be pulled outwardly from its storage position upon the axle by a force of sufficient magnitude to overcome the force exerted by the helical spring coupled to the axle. The ratchet-like projections are shaped so as to permit the line to be withdrawn from the handle in a controlled fashion without requiring manual manipulation of the arm. Also, the line is retractable at will into a storage position in the handle. When the arm is manipulated manually, the ratchet projections are disengaged from the end of the arm disposed within the handle, permitting the shaft to be automatically rotated thereby, winding up the line on the shaft.

Another embodiment of the present invention utilizes the end of the line adjacent the handle being fixedly secured thereto relying solely upon the coil spring located within the ball to permit the ball to extend along a portion of the length of the line adjacent the ball. A portion of the line, adjacent the handle, may be wrapped about a finger of the user's hand grasping the handle.

The handle may be fabricated from a plastic material such as polypropylene. The handle may have the portion thereof adjacent the end of the line attached to it separable from the handle so as to be fabricated in cap shape having threads thereon mating with threads in an adjacent portion of the handle. The spring disposed within the cavity in the handle may be of flat cross-sectional shape disposed in spiral arrangement similar to a clock spring.

Now referring to the figures and more particularly to the embodiment illustrated in FIG. 1 showing the present invention 10 having spherical ball 12 attached to elongated flexible line 14. Point 16 of line 14 is secured to handle 18. Indicia 20 are disposed on surface 22 of ball 12 so as to represent the indicia carried by a soccer ball. Knot 24 is shown disposed in line 14 adjacent to surface 26 of ball 12. Knot 28 is shown having a portion thereof emerging outwardly from surface 26 of ball 12 at a location diametrically opposed from knot 24. Line 14 is shown engaging handle 18 adjacent end 30 thereof. End 32 of handle 18 is shown having a rounded shape for safety purposes.

Figure 2:
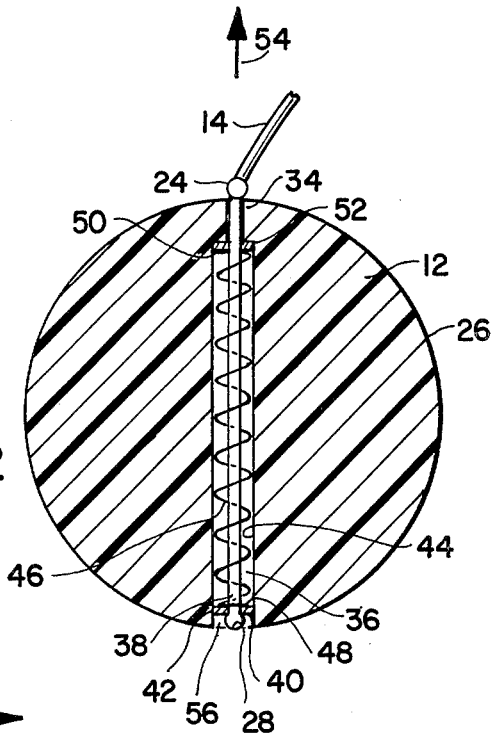
FIG. 2 is a side elevation cross-sectional view of the present invention taken along line 2—2 viewed in the direction of arrows 2—2 of the apparatus shown in FIG. 1.

FIG. 2 illustrates ball 12 having passageway 34 therein adjacent the location of knot 24 in line 14. Passageway 36 is shown coaxially aligned with passageway 34 passing through the center of origin of ball 12. Knot 28 is shown located at end 38 of line 14 adjacent the location of washer 40. Perimeter 42 of washer 40 is shown engaging wall 44 of passageway 36. Washer 40 may have an external diameter such that its perimeter need not engage walls 44 of passageway 36. Spring 46 is shown installed within passageway 36 having end 48 thereof engaging washer 40. End 50 of spring 46 is shown engaging washer 52. Washer 52 is installed in passageway 36 adjacent the intersection thereof with passageway 34. Thus, a pull on line 14, in the direction of arrow 54, causes knot 28 to force washer 40 in the direction of washer 52 by compression of spring 46. Release of such applied force to line 14 enables spring 46 to extend in length limited only by the engagement of knot 24 with the peripheral surface 26 of ball 12. Thus, knot 28 is not free to emerge unlimitedly outwardly from opening 56 of passageway 36.

Figure 3:
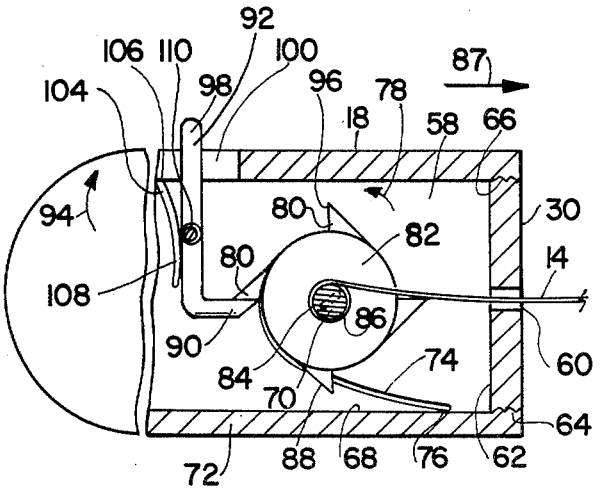
FIG. 3 is a partial cross-sectional view of the handle portion of the present invention.

FIG. 3 illustrates end 30 of handle 18 containing cavity 58 therein. Opening 60 in cap-like element 62 permits line 14 to emerge outwardly therefrom. Cap 62 is threadingly engaged to handle 18 utilizing threads 64 located on the exterior surface of cap 62 threadingly engaged with mating threads 66 disposed on the interior surface 68 of cavity 58. Axle 70 is shown housed within cavity 58 and is journaled for rotation therewithin utilizing bearings, not shown, disposed within wall 72 of housing 18. Helical spring 74 is shown having end 76 thereof engaging wall 72. The other end of helical spring 74 is fixedly secured to axle 70. Spring 74 exerts a bias force of rotation in the direction of arrow 78 on axle 70 causing ratchet-like piece 80, carried by wheel 82, to rotate concurrently with axle 70 because wheel 82 is fixedly secured to axle 70. Line 14 has end 84 thereof fixedly secured to axle 70. Portion 86 of line 14 is shown wrapped about the surface of axle 70. When a force, applied in the direction of arrow 87 is applied to line 14, portion 86 of line 14 is unwound from the surface of axle 70. Ratchet-like projections 80 are provided with ramp surfaces 88 so as to permit end 90 of arm 92 to pivot in the direction of arrow 94 allowing axle 70 to rotate. When a force is not exerted on line 14 in the direction of arrow 87, end 90 of arm 92 engages flat portions 96 of ratchet-like projections 80 thereby preventing the rotation of axle 70 in the direction of arrow 78. End 98 of arm 92 passes through slotted opening 100 in wall 72 of handle 18. Flat spring 104 is shown having end 106 engaging surface 68 of defining cavity 58. End 108 of flat spring 104 is shown engaging arm 92 intermediate pivot rod 110 used to pivotably secure arm 92 to surface 68 within cavity 58 of handle 18. Thus, end 90 of arm 92 is biased in the direction of arrow 87. When a manually applied force is applied to end 98 of arm 92 in the direction of arrow 87, end 90 of arm 92 is caused to be moved substantially in the direction opposite to the direction of arrow 87 thereby disengaging end 90 of arm 92 from flat surfaces 96 of ratchet-like projection 80. At this time, wheel 82 is free to rotate in the direction of arrow 78 causing portions of line 14, disposed outwardly of cavity 58 to be wrapped upon the surface of axle 70 utilizing helical spring 74 therefor.

One of the advantages of the present invention is to provide a tethered ball whose tether line length may be adjusted at the will of the user.

Another advantage of the present invention is to provide a tether line which is automatically retractable in length into a handle portion, thereby facilitating the use of the apparatus in a variety of games and exercises without requiring line replacements or other complicated adjustment.

Still another advantage of the present invention is to provide a tether ball wherein the ball may extend along the length of the tether line to which it is attached by virtue of the inertia of the ball as the ball is cast outwardly from a user's hand.

Yet another advantage of the present invention is to provide an inexpensive, easily fabricated tethered ball apparatus useful in a wide variety of games, exercises and other functional uses.

Thus, there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

I claim:

1. A soccer training apparatus comprising a ball, a flexible line, a handle, one end of said line secured to said ball, the other end of said line secured to said handle, means to bias said one end of said line toward the surface of said ball, means to bias said other end of said line toward said handle, means to selectively manually eliminate said means to bias said other end toward said handle and to permit said means to bias said other end of said line to urge said other end of said line toward said handle.

2. The apparatus as claimed in claim 1 wherein said means to bias said one end of said line comprises a helical spring, a passageway located in said ball, said helical spring being disposed extending along a portion of the length of said passageway, said one end of said line secured to one end of said helical spring, said one end of said helical spring being located adjacent said surface of said ball, the other end of said helical spring being secured to the walls of said passageway, a portion of the length of said line passing thru the length of said helical spring and emerging outwardly from said passageway adjacent the location of said other end of said helical spring.

3. The apparatus as claimed in claim 2 further comprising a first washer, said first washer being disposed within said passageway adjacent said one end of said helical spring, a first knot being disposed adjacent the free end of said one end of said line, said first knot being disposed in touching engagement on a lateral surface of said first washer, a second knot being disposed along the length of said line, said second knot being disposed on said surface of said ball at a location diametrically opposed to the location of said first knot.

4. The apparatus as claimed in claim 1 wherein said means to bias said other end of said line comprises an axle, said axle journaled within a cavity located in said handle, said axle carrying a plurality of ratchet-like teeth extending outwardly therefrom, said ratchet-like teeth disposed contained in said cavity, said other end of said line fixedly secured to an exterior surface of said axle, a spring, said spring having one end thereof secured to said handle, the other end of said spring being secured to said axle, said spring being wound about a portion of the surface of said axle, an arm, means to pivotably secure said arm to said handle, a portion of said arm contained within said cavity, said portion of said arm being biased toward said ratchet-like teeth, another portion of said arm emerging outwardly from said cavity through an opening in said handle and extending outwardly therefrom.

5. The apparatus as claimed in claim 1 wherein said ball comprises a rubber-like material.

6. The apparatus as claimed in claim 1 wherein said handle further comprises a cap, said cap threadingly secured to an open mouth portion of said handle defining a cavity therewithin.

7. The apparatus as claimed in claim 1 wherein said flexible line comprises polyamide.

* * * * *